United States Patent [19]

Field et al.

[11] Patent Number: 4,534,807

[45] Date of Patent: Aug. 13, 1985

[54] HEAT TREATMENT OF ALUMINIUM ALLOYS CONTAINING LITHIUM

[75] Inventors: David J. Field, Staffordshire; Ernest P. Butler, Tunbridge Wells; Katherine-Ann Bassett, Banbury, all of England

[73] Assignee: Alcan International Limited, Montreal, Canada

[21] Appl. No.: 593,958

[22] Filed: Mar. 27, 1984

[30] Foreign Application Priority Data

Apr. 6, 1983 [GB] United Kingdom ..... 8309349

[51] Int. Cl.[3] ..... C22F 1/02

[52] U.S. Cl. ..... 148/20.3

[58] Field of Search ..... 148/20.3, 13, 13.1

[56] References Cited

U.S. PATENT DOCUMENTS 4,002,505 1/1977 Bult ..... 148/20.3

*Primary Examiner*—R. Dean

*Attorney, Agent, or Firm*—Cooper, Dunham, Clark, Griffin & Moran

[57] ABSTRACT

The heat treatment of aluminium alloys having a lithium content in excess of 0.5% is carried out in an atmosphere of carbon dioxide and water vapor, the partial pressure of water vapor being at least 4 torr and more usually 10–50 torr.

6 Claims, 2 Drawing Figures

WEIGHT GAIN VS TIME FOR Al - 2·7 WEIGHT % Li AT 520°C IN $CO_2$ ATMOSPHERE SATURATED WITH WATER VAPOUR AT DIFFERENT TEMPERATURES

LITHIUM LOSS VS TIME FOR Al-2·7 WEIGHT % Li REACTED UNDER DIFFERENT ENVIRONMENTS AT 520°C

WEIGHT GAIN VS TIME FOR Al - 2·7 WEIGHT % Li AT 520°C IN $CO_2$ ATMOSPHERE SATURATED WITH WATER VAPOUR AT DIFFERENT TEMPERATURES

HEAT TREATMENT OF ALUMINIUM ALLOYS CONTAINING LITHIUM

The present invention relates to the heat treatment of aluminium alloys having a substantial content of lithium, that is to say more than 0.5% and more usually more than 1% Li. Such alloys, which may also contain Mg and/or Cu as principal alloying constituents, are of very considerable interest by virtue of the possibility of producing structural components having a high strength/weight ratio.

Owing to the reactivity of lithium, particularly at elevated temperatures, the heat treatment, such as solution heat treatment homogenisation and annealing, of such alloys presents considerable difficulties. At the solution heat treatment temperature, typically carried out at a temperature in the range of 500°-575° C. almost total loss of the lithium content may occur, particularly with thin section material, within normal heat treatment times by reason of reaction of lithium with the furnace atmosphere.

It has, of course, been found possible to reduce the rate of such reaction by control of the composition of the furnace atmosphere. In any heat treatment process of Al—Li alloys the reaction between the lithium content and the furnace atmosphere has two consequences (a) loss of lithium from the alloy (b) formation of reaction products which penetrate the intergrain boundaries. In the latter case the adverse effect of reaction products (in relation to the weight of such products) increases in line with the increase of volume due to the formation of such products. In particular the penetration of the intergrain boundaries is exceptionally undesirable in thin alloy sheet (section) because of the severe loss of alloy integrity.

For a viable commercial heat treatment operation the process conditions must be such that they can be maintained within reasonable limits of variation in commercial practice. Thus in a commercial heat treatment furnace adapted to treat a substantial load of material it is necessary to operate substantially at atmospheric pressure. It is exceedingly difficult to operate a heat treatment furnace without some ingress of atmospheric air.

Studies have been made of the effects of reducing the moisture content of the furnace atmosphere since prior studies show it to be beneficial in reducing the rate of oxidation of Mg in the case of Al—Mg alloys. In order to eliminate the effects of other potentially reactive components, particularly $N_2$ and $CO_2$, present in air, we have carried out such studies in an atmosphere composed of 80% argon and 20% oxygen.

It was found that, as represented by an increase in the weight of the treated specimen, the rate of attack was greatly decreased as the moisture content of this synthetic "air" atmosphere was decreased. However it was found that at the lowest moisture levels, which could be expected to be maintained in practical commmercial operation, the rate of oxidation of Li was unacceptably high. On the other hand when the moisture content was held at $10^{-3}$ torr the rate of attack on the Li content was considered generally acceptable.

Since commercial gases at such low moisture level are available, further tests were carried out in the laboratory to determine the rate of attack on the Li content in nitrogen and dry carbon dioxide atmospheres. In these tests the results obtained with dry nitrogen were markedly superior to those obtained with dry carbon dioxide. Not unexpectedly Li was attacked more rapidly in the dry carbon dioxide atmosphere. The rate of attack in a dry nitrogen atmosphere was equivalent to that achieved with the synthetic air (80% Ar, 20% $O_2$) of the same moisture content. It was therefore concluded that under practical conditions it would not be possible to employ a nitrogen atmosphere because of the difficulty in avoiding ingress of normal atmospheric moisture into the dry nitrogen furnace atmosphere. It was however discovered that the rate of weight gain was somewhat less for undried atmospheric air than for the argon/oxygen mixture at the same moisture content.

It was concluded that some atmospheric component was exerting an inhibiting effect on the attack of Li by oxygen in the presence of water vapour. It was confirmed that this inhibiting effect was due to carbon dioxide by Ar 80%, $O_2$20% synthetic air, which showed a small, but significant, decrease in weight gain in the presence of water vapour. In further tests employing a carbon dioxide atmosphere it was found that the rate of attack on Li was sharply decreased when the carbon dioxide atmosphere had an increased moisture content (17.5 torr $H_2O$), (about 2.3% by weight) equivalent to saturated air at 20° C. as compared with the discouraging results achieved in an atmosphere of dry carbon dioxide.

It was concluded according to the present invention that an essentially $CO_2$ atmosphere containing a definite moisture content, could be employed as an atmosphere in any heat treatment of Al—Li alloys, because ingress of small amounts of oxygen, nitrogen and water vapour from ambient atmosphere would not be specially deleterious in relation to the rate of attack on the Li content of the alloy.

According to the present invention a heat treatment of an Al—Li alloy is carried out in an atmosphere consisting essentially of carbon dioxide having a water content controlled to be in the range of 4 to 250 torr or even higher (about 0.6–31% by weight). This treatment is particularly effective in reducing oxidation of lithium in heat treatments carried out at temperatures in excess of 450° C.

It is preferred to maintain the water vapour content of the $CO_2$ at a value in the range of 10–50 torr, since this can be achieved very easily.

DETAILED DESCRIPTION

In the following Table 1 are given the weight gains recorded when holding an Al-2.7% Li (by weight) alloy at 520° C. in different dry and wet atmospheres. The weight gains are recorded as milligrams/cm$^2$.

TABLE 1

| | Atmosphere | | | | |
|---|---|---|---|---|---|
| Time Minutes | Dry 20% $O_2$ 80% Ar | Wet 20% $O_2$ 80% Ar | Dry $CO_2$ | Wet $CO_2$ | Dry $N_2$ |
| 5 | 25 | 53.3 | 91.7 | 43.3 | 5.0 |
| 10 | 74 | 145.0 | 233.3 | 105.0 | 16.6 |
| 20 | 136.6 | 266.7 | 400 | 166.7 | 80.0 |
| 45 | 224.6 | 483.3 | 645.0 | 266.7 | 235.0 |
| 60 | 226.3 | 583.3 | 756.7 | 310 | 278.0 |

TABLE 1-continued

| Time Minutes | Atmosphere Dry 20% $O_2$ 80% Ar | Wet 20% $O_2$ 80% Ar | Dry $CO_2$ | Wet $CO_2$ | Dry $N_2$ |
|---|---|---|---|---|---|
| 90 | 330.8 | 750 | 948.3 | 383.3 | 343.0 |
| 120 | 395.0 | 890 | 1100.0 | 445.0 | 401.0 |
| 180 | 494.0 | 1136.7 | 1375.0 | 550.0 | 500.0 |
| 240 | 583.3 | 1603.3 | 1596.4 | 638.3 | 586.0 |
| 300 | 648.0 | 2205 | 1785 | 715.0 | 666.0 |
| | | Weight Gain mg/cm$^2$ | | | |

Note:
"Dry" = $10^{-3}$ torr $H_2O$
"Wet" = 17.5 torr $H_2O$

The figures in the above Table show nearly equal actual weight gains in dry oxygen/argon, dry nitrogen and wet carbon dioxide atmospheres. It should be appreciated that the reaction products in different atmospheres include lithium spinel $\gamma$-$LiAlO_2$, $Li_3N$ and $Li_2CO_3$. Thus a particular weight gain cannot be directly quantified with Li loss from the alloy. Investigation of the surface deposits formed on the surface of the alloy after heating in various atmospheres has revealed that at treatment temperatures of the order of 500° C. the principal reaction product formed in wet or dry air or dry carbon dioxide is $\gamma$-$LiAlO_2$, whereas in wet $CO_2$ it is $LiAl_5O_8$, so that a given weight gain in a wet $CO_2$ atmosphere represents a much lower Li loss than for the other atmospheres.

Figure 1:
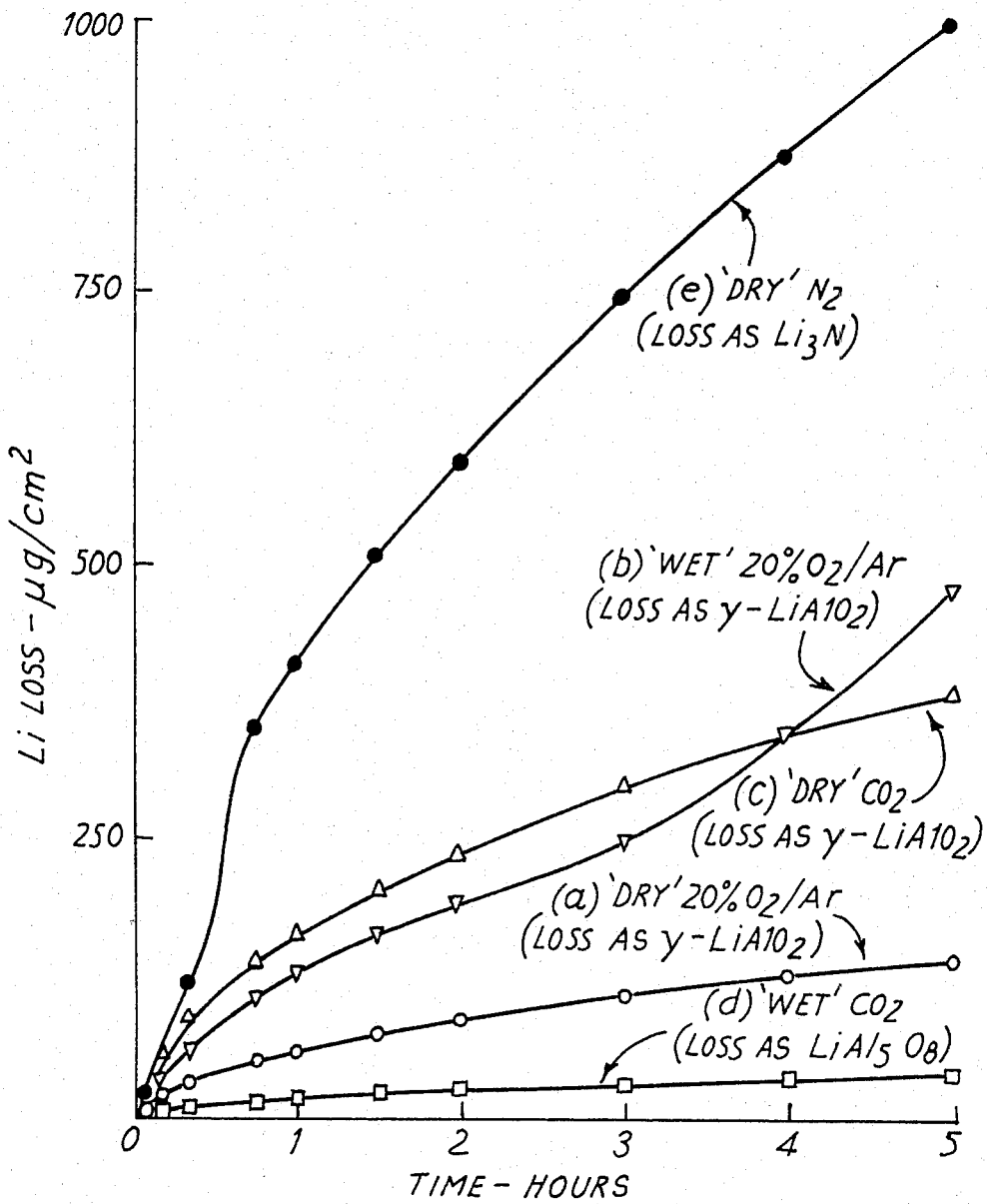
FIG. 1 is a graph of Li loss vs. time for Al-2.7 weight % Li reacted under different environments at 520° C.

In the accompanying FIG. 1 the Li loss resulting from the weight gains at treatment times in different atmospheres given in the foregoing Table is shown, calculated on the basis that all the weight gain is due to the principal reaction product present in the surface deposit.

It will be seen that heat treatment at 520° C. in $CO_2$, having a moisture content of the order of 15–20 torr results in an Li loss of only about 25% of the loss in the next least unfavourable atmosphere tested, namely dry "air". It should be noted that the maintenance of so low a moisture content as the "dry" conditions empolyed in these tests, would be difficult in an industrial heat treatment furnace. On the other hand the maintenance of the "wet" $CO_2$ atmosphere (17.5 torr $H_2O$) is extremely simple, since this can be achieved by supplying the furnace atmosphere with a stream of $CO_2$, bubbled through water at 15°–20° C. with a contact time sufficient to saturate the $CO_2$ with water vapour.

Figure 2:
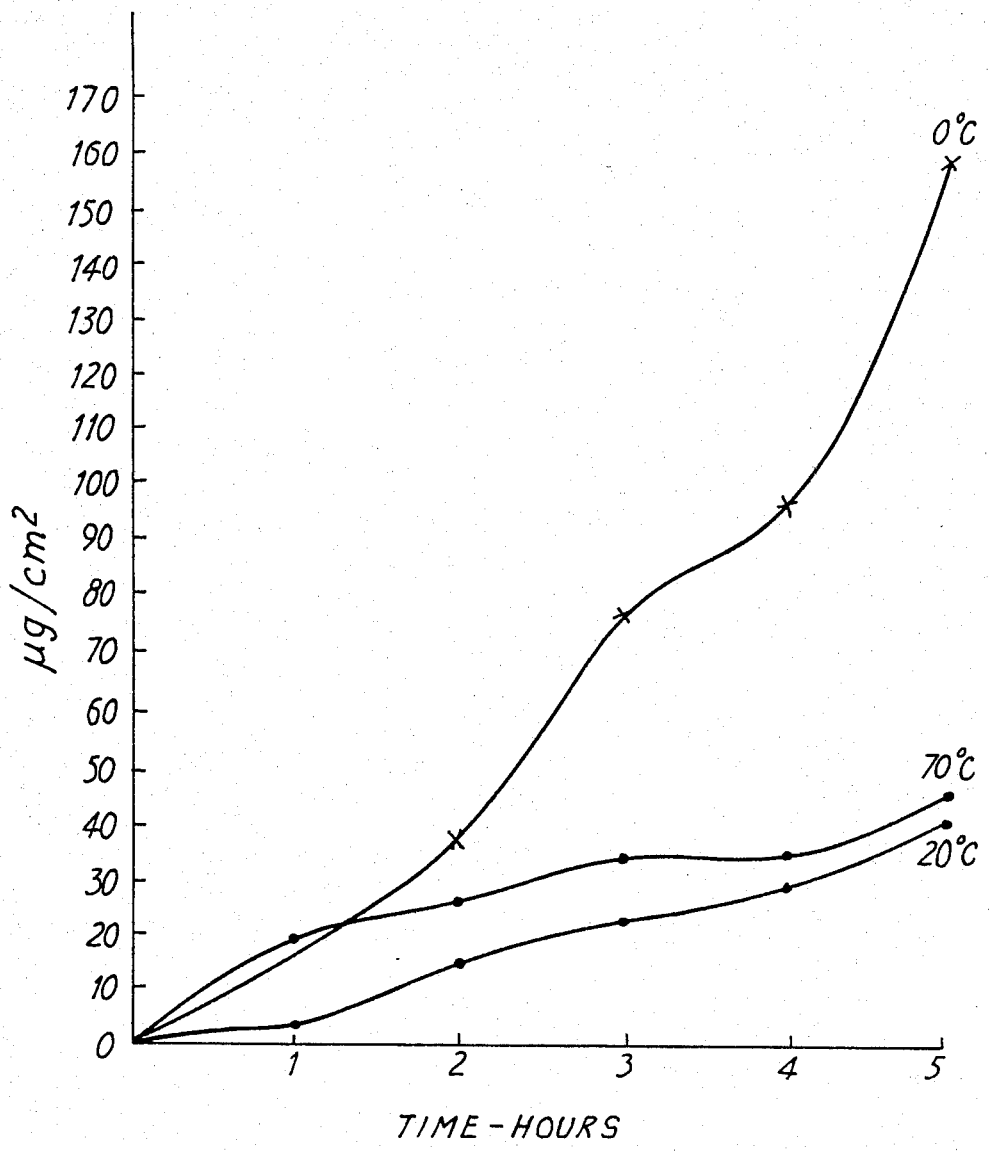
FIG. 2 is a graph of weight gain vs. time for Al-2.7% Li at 520° C. in $CO_2$ atmosphere saturated with water vapour at different temperatures.

In the accompanying FIG. 2 are graphically illustrated the weight gains resulting from the heat treatment of Al-2.7% Li alloy in a carbon dioxide atmosphere saturated with water vapour at 0° C., 20° C. and 70° C. respectively.

The partial pressure of water vapour at these temperatures approximate to 4.6 torr, 17.5 torr and 234 torr respectively.

It will be seen that even under the least favourable conditions the weight gain results in an Li loss as $LiAl_5O_8$ no greater than that achieved in dry air at $10^{-3}$ torr $H_2O$.

Further tests were carried out for the same alloy (Al, 2.7% Li) in the same atmospheres and same times as in Table 1, but at the higher temperature of 575° C.

The resulting weight gains are indicated in the following Table 2.

TABLE 2

| Time Minutes | Atmosphere Dry 20% $O_2$ 80% Ar | Wet 20% $O_2$ 80% Ar | Dry $CO_2$ | Wet $CO_2$ | Dry $N_2$ |
|---|---|---|---|---|---|
| 5 | 31.3 | 149.2 | 278.4 | 92.5 | 6.4 |
| 10 | 80.6 | 410.8 | 512.5 | 189.1 | 13.6 |
| 20 | 149.4 | 899.2 | 801.7 | 212.5 | 22.2 |
| 45 | 276.1 | 2549.2 | 1231.7 | 573.9 | 40.6 |
| 60 | 332.2 | 2962.5 | 1385.9 | 665.0 | 50.3 |
| 90 | 426.7 | 3018.4 | 1690.0 | 833.9 | 70.3 |
| 120 | 502.8 | 3052.5 | 1951.7 | 976.1 | 92.8 |
| 180 | 635.5 | 3064.2 | 2377.5 | 1181.7 | 135.0 |
| 240 | 749.5 | | | 1328.9 | 175.0 |
| 300 | 838.3 | | | 1376.7 | 193.0 |

It will be seen that at the higher temperature of 575° C., although the rate of weight gain in wet $CO_2$ is considerably higher than at the lower temperature of 520° C., the weight gain figure, when translated into terms of Li loss, represent an approximately fourfold loss of Li in dry $N_2$ as compared with the loss of Li in the wet $CO_2$ atmosphere. When the test time was increased from 1 to 5 hours, the additional Li loss was between five and six times greater in dry $N_2$ than in wet $CO_2$.

The present invention is particularly applicable to the high temperature homogenisation process for Al—Li alloys containing Cu and/or Mg, described in our copending British Patent Application No. 83.07829 and greatly reduces the Li loss involved in carrying out that very advantageous homogenisation process.

Heat treatment of Al—Li alloys, particularly such alloys containing Mg and/or Cu are however rarely if ever carried out at temperatures as high as 575° C.

Although the Li loss and weight gain involved in heat treatment, such as homogenisation heat treatment, of Al—Li alloys at temperatures somewhat below 500° C. are lower for a given treatment time the employment of a wet $CO_2$ atmosphere remains advantageous at such lower temperature.

The present procedure is tolerant of the presence of small quantities of air in the wet $CO_2$ furnace atmosphere. Preferably the total nitrogen and oxygen content of the furnace atmosphere is held below 1%. That is readily achieved by standard purging techniques. It is preferred to adopt the normal practice of carrying out the heat treatment in a furnace at a slightly superatmospheric pressure, which eliminates or greatly reduces leakage of air into the furnace atmosphere during performance of the process.

The test results given above are only for a binary Al—Li alloy, parallel tests on ternary Al—Li—Mg and Al—Li—Cu alloys and quaternary Al—Li—Mg—Cu alloys yield similar results. This would in any event be expected since at the higher temperatures most or all of the Li content of the alloy would be rapidly redissolved in the aluminium matrix and not be present in the form of a precipitated intermetallic phase.

We claim:

1. In a process for heat treating an article of an alloy having a major content of aluminium and a minor content of at least one alloying element, said one alloying element being lithium present in a proportion of above 0.5% by weight, and said process comprising the step of heating the article to a temperature above 450° C., the improvement which comprises performing said heating step in an atmosphere of carbon dioxide and water vapour, the partial pressure of water vapour in such atmosphere being at least 4 torr.

2. A process according to claim 1 further characterised in that the partial pressure of water vapour in said atmosphere is maintained at a value in the range of 4–250 torr.

3. A process according to claim 1 further characterised in that the partial pressure of water vapour in said atmosphere is maintained at a value in the range of 10–50 torr.

4. A process according to claim 1 further characterised in that total nitrogen and oxygen impurity content of said atmosphere is held below 1%.

5. A process according to claim 2 further characterised in that total nitrogen and oxygen impurity content of said atmosphere is held below 1%.

6. A process according to claim 3 further characterised in that total nitrogen and oxygen impurity content of said atmosphere is held below 1%.

* * * * *